United States Patent [19]

Bowen

[11] 3,943,320

[45] Mar. 9, 1976

[54] FRANKFURT SEARING TRAY FOR USE WITH MICROWAVE ENERGY

[75] Inventor: Robert F. Bowen, Burlington, Mass.

[73] Assignee: Raytheon Company, Lexington, Mass.

[22] Filed: June 19, 1975

[21] Appl. No.: 588,447

[52] U.S. Cl. ..... 219/10.55 E; 99/DIG. 14

[51] Int. Cl.[2] ..... H05B 9/06

[58] Field of Search 219/10.55 E, 10.55 F, 10.55 M; 99/451, DIG. 14

[56] References Cited

UNITED STATES PATENTS

| | | | |
|---|---|---|---|
| 3,230,864 | 1/1966 | Krajewski | 99/DIG. 14 |
| 3,591,751 | 7/1971 | Goltsos | 219/10.55 E |
| 3,662,141 | 5/1972 | Schauer, Jr. | 219/10.55 E |
| 3,701,872 | 10/1972 | Levinson | 219/10.55 E |
| 3,809,845 | 5/1974 | Stenstrom | 99/451 X |
| 3,845,266 | 10/1974 | Derby | 219/10.55 E |
| 3,857,009 | 12/1974 | MacMaster et al. | 219/10.55 E |
| 3,878,350 | 4/1975 | Takagi | 219/10.55 E |
| 3,881,027 | 4/1975 | Levinson | 219/10.55 E |

FOREIGN PATENTS OR APPLICATIONS

| | | | |
|---|---|---|---|
| 1,596,475 | 7/1970 | France | 99/DIG. 14 |
| 7,004,169 | 9/1970 | Netherlands | 219/10.55 E |

*Primary Examiner*—Arthur T. Grimley
*Attorney, Agent, or Firm*—Milton D. Bartlett; Joseph D. Pannone; Edgar O. Rost

[57] ABSTRACT

A utensil for heating circular elongated objects with microwave energy is disclosed for securing browning and searing of the exterior surfaces. A plurality of searing members of a curved tapered substantially V-shaped configuration encompass a portion of or all of the elongated object to be heated. The searing means are supported on a microwave transparent frame of a plastic material.

3 Claims, 3 Drawing Figures

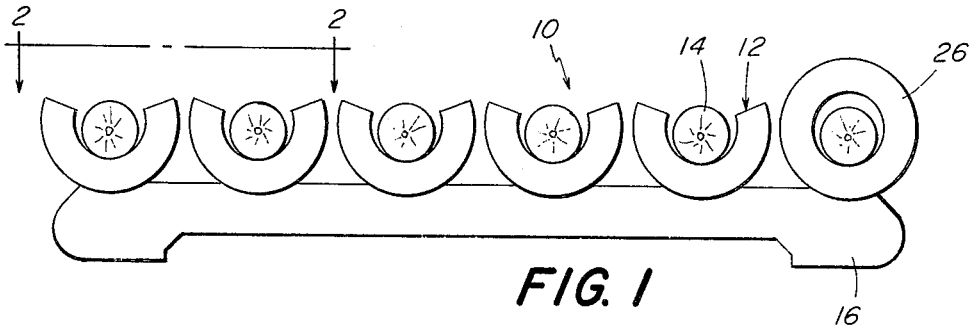
FIG. 1
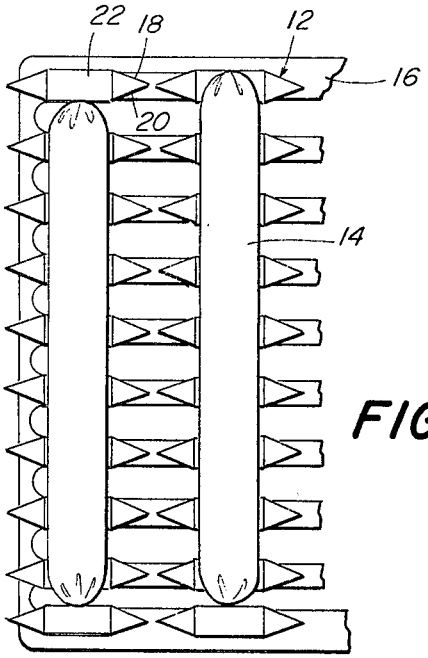
FIG. 2
FIG. 3
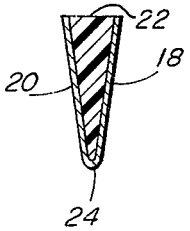

FRANKFURT SEARING TRAY FOR USE WITH MICROWAVE ENERGY

BACKGROUND OF THE INVENTION

1. Field of the Invention

The invention relates to microwave heating and means for preparing circular elongated objects.

2. Description of the Prior Art

Microwave heating is becoming increasingly popular, particularly, in the preparation of foodstuffs. The energy is radiated within an enclosure from an energy source, such as a magnetron. The waves are radiated and reflected within the enclosure to result in high frequency oscillatory movement of the molecules in the load to cause heating by molecular friction. The materials being heated have differing dielectric constant values which results in uneven heating due to varying absorption of the microwave energy. The surface coloration, therefore, is difficult to control, particularly, in the preparation of such foodstuffs as frankfurts.

An example of a prior art teaching is U.S. Pat No. 3,591,751 issued July 6, 1971 to C. E. Goltsos which discloses a plurality of half-wavelength rods to provide rapid heating of the rods by the microwave energy. The absorbed heat is then transferred by conduction to a supported load. This technique not only results in problems caused by the heating of the rods but is difficult to implement in the processing of objects which are not flat. Another example of a prior art teaching is found in copending application Ser. No. 554,861 filed Mar. 3, 1975 by G. MacMaster et al. and assigned to the assignee of the present invention. In this embodiment a plurality of conductive metal members are provided, each folded in such a manner as to provide a continuous apex portion and two spaced apart adjacent leg portions. The conductive members are disposed in a linear array and the apparatus is not efficient for heating circular elongated objects.

A need arises, therefore, for an improved microwave heating means for processing circular elongated objects such as frankfurts.

SUMMARY OF THE INVENTION

A plurality of conductive members is provided having a curved configuration to encompass a portion or all of the object to be heated. The conductive members are supported by a member of a dielectric material such as the plastic material polysulfone which is accepted for use with foods. The combined conductive members and the supporting member forms a tray and the objects to be heated may be top loaded or end loaded depending on the disposition of the conductive members. Such members in the semicircular configuration are adapted for top loading. The circular embodiment completely surrounding the object to be heated is adapted for end loading. The conductive members are provided with two adjacent leg portions and a continuous apex portion. The leg portions have an overall height of substantially one-quarter of a wvelength of the microwave energy. The overall height may be reduced by filling the area between the leg portions with a dielectric material.

BRIEF DESCRIPTION OF THE DRAWINGS

Details of the invention will be readily understood after consideration of the following description of an illustrative embodiment and reference to the accompanying drawings, wherein:

FIG. 1 is an end view of an illustrative embodiment showing both the top loading and end loading capability;

FIG. 2 is a plan view of a portion of the illustrative embodiment taken along the line 2—2 in FIG. 1; and FIG. 3 is a cross-sectional view of a conductive member utilized in the embodiment of the invention.

DESCRIPTION OF THE PREFERRED EMBODIMENT

The illustrative embodiment 10 shown in the drawings comprises a plurality of curved conductive members 12 adapted to accomodate an elongated object such as a frankfurt 14. The conductive members are spaced throughout the length of the object at periodic intervals and are curved to provide a semicircular configuration. The conductive elements 12 are supported by and joined to body member 16 of a plastic material which is compatable with foods, such as polysulfone. The plastic is attached by notching a portion of the conductive member curved surfaces and flowing the plastic material in its liquid state within the notches. A series interconnected of body members 16 are arranged in an array with each of the conductive members disposed on a separate body member 16.

Referring to FIG. 3 the individual conductive members will be described. The conductive members have two leg portions 18 and 20 which are joined by a continuous apex portion 24 to provide a substantially V-shape configuration. The microwave energy in the form of free space plane waves are intercepted at the apex portion and the induced currents traverse each of the leg portions to provide a 180° out-of-phase intense fringing electric field pattern adjacent the open ends of the leg portions. To achieve the desired field pattern each of the leg portions 18 and 20 is substantially one-quarter of a wavelength of the microwave energy in length. If the opening between the leg portions is filled with a dielectric material 22 the one-quarter wavelength dimension will be shorter. In an illustrative embodiment a dielectric material having a dielectric constant value of 9 was utilized and the length of the leg portions was approximately 0.400 inches. The microwave energy utilized in this embodiment has an operating frequency of 2450 MHz. This frequency is one of the frequencies in the Industrial, Scientific and Medical Band allocated by federal regulatory bodies such as the F.C.C.

The object to be cooked rests against the open ends of the conductive members 12. As shown in FIG. 1 the first five rows of conductive members are semicircular to provide for top loading of the object to be heated with microwave energy. An alternative arrangement is shown in this view and comprises circular conductive members 26 completely encompassing the elongated object to be heated. In this configuration the objects are loaded from the end.

The combined trays after loading are disposed within an enclosure of the well known type used in microwave heating apparatus and the microwave energy is radiated. The objects will be cooked and also seared on the exterior surfaces in the vicinity of the conductive members. The disclosed tray may be utilized individually or a large number of such trays may be provided in an automated device for processing a larger number of the elongated objects to be heated with microwave energy.

Modifications will be evident to those skilled in the art. The foregoing description of the embodiment is, therefore, to be considered broadly and not in a limiting sense.

I claim:

1. An apparatus for heating circular elongated objects with microwave energy comprising:

a plurality of curved conductive members surrounding a substantial portion of the objects to be heated;

means for supporting said members;

each of said conductive members defining two leg portions and a continuous apex portion;

said leg portions having a length substantially equal to one-quarter of a wavelength of the microwave energy utilized;

said conductive members providing adjacent to the ends of said leg portions an intense out-of-phase fringing electric field pattern when radiated by microwave energy.

2. The apparatus according to claim 1 wherein said conductive members have a semicircular configuration.

3. The apparatus according to claim 1 wherein said conductive members have a circular configuration.

* * * * *